US007800637B2

(12) United States Patent
Huang et al.

(10) Patent No.: US 7,800,637 B2
(45) Date of Patent: Sep. 21, 2010

(54) OVERDRIVE GRAY LEVEL DATA MODIFIER AND METHOD OF LOOKING UP THEREOF

(75) Inventors: Chung-Hsun Huang, Hsinhua (TW); Pen-Hsin Chen, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 746 days.

(21) Appl. No.: 11/328,198

(22) Filed: Jan. 10, 2006

(65) Prior Publication Data

US 2006/0152535 A1 Jul. 13, 2006

(30) Foreign Application Priority Data

Jan. 10, 2005 (TW) ..... 94100670 A

(51) Int. Cl.
*G09G 3/36* (2006.01)
*G09G 5/10* (2006.01)

(52) U.S. Cl. ..... 345/690; 345/89

(58) Field of Classification Search ..... 345/89, 345/690

See application file for complete search history.

(56) References Cited

U.S. PATENT DOCUMENTS 4,799,053 A 1/1989 Van Aken et al.
5,204,664 A 4/1993 Hamakawa et al.
5,751,843 A * 5/1998 Maggioni et al. ..... 382/154
6,356,276 B1 * 3/2002 Acharya ..... 345/600
6,803,917 B2 * 10/2004 Champion et al. ..... 345/540
2002/0196218 A1 12/2002 Ham
2003/0098839 A1 * 5/2003 Lee ..... 345/89
2004/0131117 A1 * 7/2004 Sheraizin et al. ..... 375/240.12
2005/0062703 A1 * 3/2005 Lee et al. ..... 345/89

FOREIGN PATENT DOCUMENTS

TW 548616 8/2003
TW 2004-28335 12/2004

* cited by examiner

*Primary Examiner*—Amr Awad
*Assistant Examiner*—Andre Matthews
(74) *Attorney, Agent, or Firm*—Rabin & Berdo, PC

(57) ABSTRACT

An overdrive gray level data modifier and method of looking up thereof are provided. The overdrive data modifier obtains and outputs overdrive gray level data according to several overdrive gray values corresponding to several previous gray level index values and several current gray level index values. The overdrive data modifier includes a first, a second, a third and a fourth memory unit. The overdrive gray values are respectively stored in the first, the second, the third and the fourth memory unit. Firstly, a previous gray level index value and a current gray level index value are compared according to a current frame gray level data and a previous frame gray level data, and at least a corresponding overdrive gray level data are obtained from the overdrive gray value. At last, the overdrive gray level data are obtained according to the corresponding overdrive gray level data.

16 Claims, 5 Drawing Sheets

| | | PF | | | | | | | | | | | | | | | |
|---|---|---|---|---|---|---|---|---|---|---|---|---|---|---|---|---|---|
| | | 16 | 32 | 48 | 64 | 80 | 96 | 112 | 128 | 144 | 160 | 176 | 192 | 208 | 224 | 240 | 255 |
| | 0 | 0 | 0 | 0 | 0 | 0 | 0 | 0 | 0 | 0 | 0 | 0 | 0 | 0 | 0 | 0 | 0 |
| | 16 | 16 | 16 | 8 | 8 | 8 | 8 | 8 | 8 | 6 | 6 | 6 | 8 | 8 | 8 | 8 | 8 |
| | 32 | 50 | 37 | 16 | 8 | 8 | 8 | 8 | 8 | 8 | 8 | 11 | 8 | 8 | 8 | 8 | 10 |
| | 48 | 96 | 64 | 60 | 32 | 24 | 24 | 16 | 16 | 16 | 14 | 20 | 8 | 8 | 8 | 8 | 16 |
| | 64 | 120 | 120 | 96 | 72 | 56 | 48 | 40 | 40 | 32 | 32 | 24 | 16 | 8 | 8 | 10 | 16 |
| | 80 | 172 | 152 | 136 | 96 | 84 | 72 | 64 | 56 | 56 | 48 | 48 | 40 | 32 | 24 | 16 | 16 |
| | 96 | 144 | 164 | 152 | 120 | 104 | 104 | 88 | 80 | 72 | 64 | 64 | 56 | 48 | 48 | 40 | 32 |
| | 112 | 192 | 176 | 168 | 136 | 128 | 120 | 120 | 104 | 96 | 96 | 88 | 80 | 72 | 64 | 56 | 48 |
| CF | 128 | 208 | 184 | 176 | 168 | 152 | 144 | 136 | 132 | 120 | 112 | 112 | 104 | 96 | 88 | 80 | 72 |
| | 144 | 168 | 200 | 188 | 176 | 168 | 160 | 160 | 152 | 144 | 144 | 136 | 128 | 120 | 112 | 104 | 96 |
| | 160 | 184 | 212 | 200 | 192 | 184 | 176 | 176 | 168 | 168 | 160 | 160 | 152 | 144 | 136 | 136 | 120 |
| | 176 | 224 | 219 | 208 | 200 | 200 | 192 | 192 | 184 | 184 | 184 | 180 | 168 | 168 | 160 | 160 | 144 |
| | 192 | 230 | 224 | 220 | 216 | 212 | 208 | 208 | 200 | 200 | 200 | 192 | 192 | 192 | 184 | 176 | 176 |
| | 208 | 236 | 232 | 228 | 228 | 224 | 224 | 224 | 216 | 216 | 216 | 216 | 216 | 210 | 208 | 200 | 192 |
| | 224 | 243 | 243 | 240 | 240 | 240 | 232 | 232 | 232 | 232 | 232 | 232 | 232 | 228 | 240 | 224 | 216 |
| | 240 | 248 | 248 | 248 | 248 | 248 | 248 | 248 | 248 | 248 | 248 | 248 | 248 | 240 | 240 | 240 | 240 |
| | | 0 | 16 | 32 | 48 | 64 | 80 | 96 | 112 | 128 | 144 | 160 | 176 | 192 | 208 | 224 | 240 |
| | | PF | | | | | | | | | | | | | | | |

L1

| | | PF | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| CF | 0 | 0 | 0 | 0 | 0 | 0 | 0 | 0 | 0 | 0 | 0 | 0 | 0 | 0 | 0 | 0 | 0 | 0 |
| | 16 | 16 | 16 | 16 | 8 | 8 | 8 | 8 | 8 | 8 | 6 | 6 | 6 | 8 | 8 | 8 | 8 | 8 |
| | 32 | 50 | 37 | 32 | 16 | 8 | 8 | 8 | 8 | 8 | 8 | 8 | 11 | 8 | 8 | 8 | 8 | 10 |
| | 48 | 96 | 64 | 60 | 48 | 32 | 24 | 24 | 16 | 16 | 16 | 14 | 20 | 8 | 8 | 8 | 8 | 16 |
| | 64 | 120 | 120 | 96 | 72 | 64 | 56 | 48 | 40 | 40 | 32 | 32 | 24 | 16 | 8 | 8 | 10 | 16 |
| | 80 | 172 | 152 | 136 | 96 | 84 | 80 | 72 | 64 | 56 | 56 | 48 | 48 | 40 | 32 | 24 | 16 | 16 |
| | 96 | 144 | 164 | 152 | 120 | 104 | 104 | 96 | 88 | 80 | 72 | 64 | 64 | 56 | 48 | 48 | 40 | 32 |
| | 112 | 192 | 176 | 168 | 136 | 128 | 120 | 120 | 112 | 104 | 96 | 96 | 88 | 80 | 72 | 64 | 56 | 48 |
| | 128 | 208 | 184 | 176 | 168 | 152 | 144 | 136 | 132 | 128 | 120 | 112 | 112 | 104 | 96 | 88 | 80 | 72 |
| | 144 | 168 | 200 | 188 | 176 | 168 | 160 | 160 | 152 | 144 | 144 | 144 | 136 | 128 | 120 | 112 | 104 | 96 |
| | 160 | 184 | 212 | 200 | 192 | 184 | 176 | 176 | 168 | 168 | 160 | 160 | 160 | 152 | 144 | 136 | 136 | 120 |
| | 176 | 224 | 219 | 208 | 200 | 200 | 192 | 192 | 184 | 184 | 184 | 180 | 176 | 168 | 168 | 160 | 160 | 144 |
| | 192 | 230 | 224 | 220 | 216 | 212 | 208 | 208 | 200 | 200 | 200 | 192 | 192 | 192 | 192 | 184 | 176 | 176 |
| | 208 | 236 | 232 | 228 | 228 | 224 | 224 | 224 | 216 | 216 | 216 | 216 | 216 | 210 | 208 | 208 | 200 | 192 |
| | 224 | 243 | 243 | 240 | 240 | 240 | 232 | 232 | 232 | 232 | 232 | 232 | 232 | 228 | 240 | 224 | 224 | 216 |
| | 240 | 248 | 248 | 248 | 248 | 248 | 248 | 248 | 248 | 248 | 248 | 248 | 248 | 240 | 240 | 240 | 240 | 240 |
| | 255 | 255 | 255 | 255 | 255 | 255 | 255 | 255 | 255 | 255 | 255 | 255 | 255 | 255 | 255 | 255 | 255 | 255 |

FIG. 2(PRIOR ART)

| | | PF | | | | | | | | | | | | | | | |
|---|---|---|---|---|---|---|---|---|---|---|---|---|---|---|---|---|---|
| | | 16 | 32 | 48 | 64 | 80 | 96 | 112 | 128 | 144 | 160 | 176 | 192 | 208 | 224 | 240 | 255 |
| CF | 0 | 0 | 0 | 0 | 0 | 0 | 0 | 0 | 0 | 0 | 0 | 0 | 0 | 0 | 0 | 0 | 0 |
| | 16 | 16 | 16 | 8 | 8 | 8 | 8 | 8 | 8 | 6 | 6 | 6 | 8 | 8 | 8 | 8 | 8 |
| | 32 | 50 | 37 | 16 | 8 | 8 | 8 | 8 | 8 | 8 | 8 | 11 | 8 | 8 | 8 | 8 | 10 |
| | 48 | 96 | 64 | 60 | 32 | 24 | 24 | 16 | 16 | 16 | 14 | 20 | 8 | 8 | 8 | 8 | 16 |
| | 64 | 120 | 120 | 96 | 72 | 56 | 48 | 40 | 40 | 32 | 32 | 24 | 16 | 8 | 8 | 10 | 16 |
| | 80 | 172 | 152 | 136 | 96 | 84 | 72 | 64 | 56 | 56 | 48 | 48 | 40 | 32 | 24 | 16 | 16 |
| | 96 | 144 | 164 | 152 | 120 | 104 | 104 | 88 | 80 | 72 | 64 | 64 | 56 | 48 | 48 | 40 | 32 |
| | 112 | 192 | 176 | 168 | 136 | 128 | 120 | 120 | 104 | 96 | 96 | 88 | 80 | 72 | 64 | 56 | 48 |
| | 128 | 208 | 184 | 176 | 168 | 152 | 144 | 136 | 132 | 120 | 112 | 112 | 104 | 96 | 88 | 80 | 72 |
| | 144 | 168 | 200 | 188 | 176 | 168 | 160 | 160 | 152 | 144 | 144 | 136 | 128 | 120 | 112 | 104 | 96 |
| | 160 | 184 | 212 | 200 | 192 | 184 | 176 | 176 | 168 | 168 | 160 | 160 | 152 | 144 | 136 | 136 | 120 |
| | 176 | 224 | 219 | 208 | 200 | 200 | 192 | 192 | 184 | 184 | 184 | 180 | 168 | 168 | 160 | 160 | 144 |
| | 192 | 230 | 224 | 220 | 216 | 212 | 208 | 208 | 200 | 200 | 200 | 192 | 192 | 192 | 184 | 176 | 176 |
| | 208 | 236 | 232 | 228 | 228 | 224 | 224 | 224 | 216 | 216 | 216 | 216 | 216 | 210 | 208 | 200 | 192 |
| | 224 | 243 | 243 | 240 | 240 | 240 | 232 | 232 | 232 | 232 | 232 | 232 | 232 | 228 | 240 | 224 | 216 |
| | 240 | 248 | 248 | 248 | 248 | 248 | 248 | 248 | 248 | 248 | 248 | 248 | 248 | 240 | 240 | 240 | 240 |
| | | 0 | 16 | 32 | 48 | 64 | 80 | 96 | 112 | 128 | 144 | 160 | 176 | 192 | 208 | 224 | 240 |
| | | PF | | | | | | | | | | | | | | | |

L1

FIG. 3

| | | PF | | | | | | | |
|---|---|---|---|---|---|---|---|---|---|
| | | 16 | 48 | 80 | 112 | 144 | 176 | 208 | 240 |
| CF | 0 | 0 | 0 | 0 | 0 | 0 | 0 | 0 | 0 |
| | 16 | 16 | 8 | 8 | 8 | 6 | 6 | 8 | 8 |
| | 32 | 50 | 16 | 8 | 8 | 8 | 11 | 8 | 8 |
| | 48 | 96 | 60 | 24 | 16 | 16 | 20 | 8 | 8 |
| | 64 | 120 | 96 | 56 | 40 | 32 | 24 | 8 | 10 |
| | 80 | 172 | 136 | 84 | 64 | 56 | 48 | 32 | 16 |
| | 96 | 144 | 152 | 104 | 88 | 72 | 64 | 48 | 40 |
| | 112 | 192 | 168 | 128 | 120 | 96 | 88 | 72 | 56 |
| | 128 | 208 | 176 | 152 | 136 | 120 | 112 | 96 | 80 |
| | 144 | 168 | 188 | 168 | 160 | 144 | 136 | 120 | 104 |
| | 160 | 184 | 200 | 184 | 176 | 168 | 160 | 144 | 136 |
| | 176 | 224 | 208 | 200 | 192 | 184 | 180 | 168 | 160 |
| | 192 | 230 | 220 | 212 | 208 | 200 | 192 | 192 | 176 |
| | 208 | 236 | 228 | 224 | 224 | 216 | 216 | 210 | 200 |
| | 224 | 243 | 240 | 240 | 232 | 232 | 232 | 228 | 224 |
| | 240 | 248 | 248 | 248 | 248 | 248 | 248 | 240 | 240 |
| | | 0 | 32 | 64 | 96 | 128 | 160 | 192 | 224 |
| | | PF | | | | | | | |

L21

FIG. 4A

| | | PF | | | | | | | |
|---|---|---|---|---|---|---|---|---|---|
| | | 32 | 64 | 96 | 128 | 160 | 192 | 224 | 255 |
| CF | 0 | 0 | 0 | 0 | 0 | 0 | 0 | 0 | 0 |
| | 16 | 16 | 8 | 8 | 8 | 6 | 8 | 8 | 8 |
| | 32 | 37 | 8 | 8 | 8 | 8 | 8 | 8 | 10 |
| | 48 | 64 | 32 | 24 | 16 | 14 | 8 | 8 | 16 |
| | 64 | 120 | 72 | 48 | 40 | 32 | 16 | 8 | 16 |
| | 80 | 152 | 96 | 72 | 56 | 48 | 40 | 24 | 16 |
| | 96 | 164 | 120 | 104 | 80 | 64 | 56 | 48 | 32 |
| | 112 | 176 | 136 | 120 | 104 | 96 | 80 | 64 | 48 |
| | 128 | 184 | 168 | 144 | 132 | 112 | 104 | 88 | 72 |
| | 144 | 200 | 176 | 160 | 152 | 144 | 128 | 112 | 96 |
| | 160 | 212 | 192 | 176 | 168 | 160 | 152 | 136 | 120 |
| | 176 | 219 | 200 | 192 | 184 | 184 | 168 | 160 | 144 |
| | 192 | 224 | 216 | 208 | 200 | 200 | 192 | 184 | 176 |
| | 208 | 232 | 228 | 224 | 216 | 216 | 216 | 208 | 192 |
| | 224 | 243 | 240 | 232 | 232 | 232 | 232 | 240 | 216 |
| | 240 | 248 | 248 | 248 | 248 | 248 | 248 | 240 | 240 |
| | | 16 | 48 | 80 | 112 | 144 | 176 | 208 | 240 |
| | | PF | | | | | | | |

L22

FIG. 4B

| | | PF | | | | | | | |
|---|---|---|---|---|---|---|---|---|---|
| | | 16 | 48 | 80 | 112 | 144 | 176 | 208 | 240 |
| CF | 0 | 0 | 0 | 0 | 0 | 0 | 0 | 0 | 0 |
| | 32 | 50 | 16 | 8 | 8 | 8 | 11 | 8 | 8 |
| | 64 | 120 | 96 | 56 | 40 | 32 | 24 | 8 | 10 |
| | 96 | 144 | 152 | 104 | 88 | 72 | 64 | 48 | 40 |
| | 128 | 208 | 176 | 152 | 136 | 120 | 112 | 96 | 80 |
| | 160 | 184 | 200 | 184 | 176 | 168 | 160 | 144 | 136 |
| | 192 | 230 | 220 | 212 | 208 | 200 | 192 | 192 | 176 |
| | 224 | 243 | 240 | 240 | 232 | 232 | 232 | 228 | 224 |
| | | 0 | 32 | 64 | 96 | 128 | 160 | 192 | 224 |
| | | PF | | | | | | | |

L31

FIG. 5A

| | | PF | | | | | | | |
|---|---|---|---|---|---|---|---|---|---|
| | | 16 | 48 | 80 | 112 | 144 | 176 | 208 | 240 |
| CF | 16 | 16 | 8 | 8 | 8 | 6 | 6 | 8 | 8 |
| | 48 | 96 | 60 | 24 | 16 | 16 | 20 | 8 | 8 |
| | 80 | 172 | 136 | 84 | 64 | 56 | 48 | 32 | 16 |
| | 112 | 192 | 168 | 128 | 120 | 96 | 88 | 72 | 56 |
| | 144 | 168 | 188 | 168 | 160 | 144 | 136 | 120 | 104 |
| | 176 | 224 | 208 | 200 | 192 | 184 | 180 | 168 | 160 |
| | 208 | 236 | 228 | 224 | 224 | 216 | 216 | 210 | 200 |
| | 240 | 248 | 248 | 248 | 248 | 248 | 248 | 240 | 240 |
| | | 0 | 32 | 64 | 96 | 128 | 160 | 192 | 224 |
| | | PF | | | | | | | |

L32

FIG. 5B

| | | PF | | | | | | | |
|---|---|---|---|---|---|---|---|---|---|
| | | 32 | 64 | 96 | 128 | 160 | 192 | 224 | 255 |
| CF | 0 | 0 | 0 | 0 | 0 | 0 | 0 | 0 | 0 |
| | 32 | 37 | 8 | 8 | 8 | 8 | 8 | 8 | 10 |
| | 64 | 120 | 72 | 48 | 40 | 32 | 16 | 8 | 16 |
| | 96 | 164 | 120 | 104 | 80 | 64 | 56 | 48 | 32 |
| | 128 | 184 | 168 | 144 | 132 | 112 | 104 | 88 | 72 |
| | 160 | 212 | 192 | 176 | 168 | 160 | 152 | 136 | 120 |
| | 192 | 224 | 216 | 208 | 200 | 200 | 192 | 184 | 176 |
| | 224 | 243 | 240 | 232 | 232 | 232 | 232 | 240 | 216 |
| | | 16 | 48 | 80 | 112 | 144 | 176 | 208 | 240 |
| | | PF | | | | | | | |

L33

FIG. 5C

| | | PF | | | | | | | |
|---|---|---|---|---|---|---|---|---|---|
| | | 32 | 64 | 96 | 128 | 160 | 192 | 224 | 255 |
| CF | 16 | 16 | 8 | 8 | 8 | 6 | 8 | 8 | 8 |
| | 48 | 64 | 32 | 24 | 16 | 14 | 8 | 8 | 16 |
| | 80 | 152 | 96 | 72 | 56 | 48 | 40 | 24 | 16 |
| | 112 | 176 | 136 | 120 | 104 | 96 | 80 | 64 | 48 |
| | 144 | 200 | 176 | 160 | 152 | 144 | 128 | 112 | 96 |
| | 176 | 219 | 200 | 192 | 184 | 184 | 168 | 160 | 144 |
| | 208 | 232 | 228 | 224 | 216 | 216 | 216 | 208 | 192 |
| | 240 | 248 | 248 | 248 | 248 | 248 | 248 | 240 | 240 |
| | | 16 | 48 | 80 | 112 | 144 | 176 | 208 | 240 |
| | | PF | | | | | | | |

L34

FIG. 5D

OVERDRIVE GRAY LEVEL DATA MODIFIER AND METHOD OF LOOKING UP THEREOF

This application claims the benefit of Taiwan application Serial No. 94100670, filed Jan. 10, 2005, the subject matter of which is incorporated herein by reference.

BACKGROUND OF THE INVENTION

1. Field of the Invention

The invention relates in general to an overdrive data modifier and method of looking up thereof, and more particularly to an overdrive gray level data modifier and method of looking up thereof.

2. Description of the Related Art

With the features of thinness, lightweight, compactness, and low radiation, liquid crystal display (LCD) has been widely used in recent years. Refer to both FIG. 1A and FIG. 1B. FIG. 1A is a timing diagram of gray values of liquid crystal molecules, and FIG. 1B is a timing diagram of input voltages. When the liquid crystal molecules are driven by an input voltage V1, the gray value of liquid crystal molecules is L1, and when the liquid crystal molecules are driven by an input voltage V2, the gray value of liquid crystal molecules is L2.

When the input voltage is converted from voltage V1 to V2 at time point t1, the gray value of liquid crystal molecules is converted to L2 from L1. Due to the characteristics of the liquid crystal molecules, the required time for the gray value to be converted from L1 to L2 is from time point t1 to time point t3, and the behavior of the gray values is illustrated in the curve C1. When time point changes from t4 to t6, the voltage value V2 is converted to V1, enabling the gray value of liquid crystal molecules to be converted from L2 to L1 as illustrated in the curve C3. However, facing the increase in resolution and display frequency, the change rate in the gray value of liquid crystal molecules would be too slow thus resulting in a residual image, if the change rate of the gray value of liquid crystal molecules still behavior as in the curve C1. Therefore, an overdrive method is provided. At time point t1, the original input voltage V2 used to drive the liquid crystal molecules is displaced by an overdrive input voltage V2' so that the required time for the gray value to be converted from L1 to L2 is reduced to be as short as from time point t1 to time point t2, and then the input voltage V2 is resumed again as shown in the curve C2. Similarly, at time point t4, the original input voltage V1 used to drive the liquid crystal molecules is displaced by an overdrive input voltage V1' so that the required time for the gray value to be converted from L2 to L1 is reduced to be as short as from time point t4 to time point t5, and then the input voltage V1 is resumed again as shown in the curve C4.

When simply providing the liquid crystal molecules with overdrive input voltage V1' and V2', the corresponding overdrive gray values OD are recorded, and the overdrive gray values OD along with the correspondence relationship between the previous gray level compared value PF and the current gray level compared value CF are recorded together to form an overdrive look-up table. The overdrive gray value OD used when converting a gray value can be determined according to the overdrive look-up table. In terms of the gray value 256, the overdrive look-up table formed by the previous gray level compared value PF and the current gray level compared value CF contains 256*256 items of overdrive gray values OD. The data volume being too large is reduced to a 17*17 overdrive look-up table, so that an overdrive data modifier capable of reducing the overdrive look-up table can be achieved. Referring to FIG. 2, a 17*17 overdrive look-up table is shown.

However, if the previous frame gray level data equals to 180, and the current frame gray level data equals to 70, it can be looked up from the FIG. 2 that the corresponding overdrive gray value OD when the current gray level compared value CF equals to 64 and the previous gray level compared value PF equals to 176 is 24, that the corresponding overdrive gray value OD when the current gray level compared value CF equals to 64 and the previous gray level compared value PF equals to 192 is 16, that the corresponding overdrive gray value OD when the current gray level compared value CF equals to 80 and the previous gray level compared value PF equals to 176 is 48, and that the corresponding overdrive gray value OD when the current gray level compared value CF equals to 80 and the previous gray level compared value PF equals to 192 is 40. According to the four overdrive gray values OD, namely 24, 16, 48 and 40, the required overdrive gray level data are obtained by using interpolation to overdrive the liquid crystal molecules. The corresponding overdrive gray value OD obtained, using the interpolation according to the two overdrive gray values 24 and 16, is 22. The formula is expressed as:

$$24-[(24-16)/16]*(180-176)=22;$$

The corresponding overdrive gray value OD obtained, using the interpolation according to the two overdrive gray values 48 and 40, is 46. The formula is expressed as:

$$48-[(48-40)/16]*(180-176)=46; \text{ and}$$

The last overdrive gray value OD obtained, using the interpolation according to the two overdrive gray values 22 and 46, is 31. The formula is expressed as:

$$22+[(46-22)/16]*70-64)=31.$$

The memory unit used in an overdrive data modifier is normally a static random access memory (SRAM) or a read only memory (ROM). Since four overdrive gray values OD require four times of reading, the reading rate of the memory unit is usually too slow to achieve the object of accessing the overdrive gray values OD within one clock cycle.

SUMMARY OF THE INVENTION

It is therefore the object of the invention to provide an overdrive gray level data modifier and method of looking up thereof.

According to an object of the invention, a gray level data device is provided. The gray level data device obtains a drive gray level data according to M*N gray values OD(1,1)~OD(M,N) corresponding to M first gray level compared values X(1)~X(M) and N second gray level compared values Y(1)~Y(N). The gray level data device includes a first memory unit and a second memory unit. The M first gray level compared values X(1)~X(M) include a first gray level compared value X(i), and the N second gray level compared values Y(1)~Y(N) include a second gray level compared value Y(j), wherein i is smaller than or equal to M, j is smaller than or equal to N, i, j, M and N are integers. If i is an odd number, then the gray values OD(i, 1)~OD(i, N) corresponding to the first gray level compared value X(i) are stored in the first memory unit. If i is an even number, then the gray values OD(i, 1)~OD(i, N) corresponding to the first gray level compared value X(i) are stored in the second memory unit.

According to yet another object of the invention, an overdrive gray level data modifier is provided. The overdrive gray level data modifier obtains an overdrive gray level data according to M*N overdrive gray values OD(1,1)~OD(M,N) corresponding to M previous gray level compared values PF(1)~PF(M) and N current gray level compared values CF(1)~CF(N). The overdrive gray level data modifier includes a first memory unit and a second memory unit. The M previous gray level compared values PF(1)~PF(M) include a previous gray level compared value PF(i) and a previous gray level compared value PF(i+1), and the N current gray level compared values CF(1)~CF(N) include a current gray level compared value CF(j) and a current gray level compared value CF(j+1), wherein i is smaller than M, j is smaller than N, i, j, M and N are integers. The overdrive gray values OD(1, j)~OD(M, j) corresponding to the current gray level compared value CF(j) are stored in the first memory unit. The overdrive gray values OD(1, j+1)~OD(M, j+1) corresponding to the current gray level compared value CF(j+1) are stored in the second memory unit.

According to another object of the invention, an overdrive gray level data looking-up method applied in the overdrive data modifier according to the invention is provided. At first, a current frame gray level data and a previous frame gray level data are received. Next, M previous gray level compared values PF and N current gray level compared values CF are referred according to current frame gray level data and previous frame gray level data to obtain at least a corresponding overdrive gray level data from an overdrive gray value OD. At last, an overdrive gray level data is obtained according to the corresponding overdrive gray level data.

According to another object of the invention, a gray level data looking-up method applied in the gray level data device according to the invention is provided. At first, a first gray level data and a second gray level data are received. Next, the first gray level compared value X and the second gray level compared value Y are referred according to the first gray level data and the second gray level data to obtain a first corresponding gray level data from the first memory unit and obtain a second corresponding gray level data from the second memory unit. At last, the drive gray level data is obtained according to the first and the second corresponding gray level data.

According to another object of the invention, a gray level data looking-up method is provided. At first, a first gray level data and a second gray level data are received. Next, a first gray level compared values X and a second gray level compared values Y are referred according to the first gray level data and the second gray level data to obtain at least two index values. Then, at least two memory units are looked up simultaneously according to the at least two index values to obtain at least a corresponding gray level data. At last, the drive gray level data is obtained according to the corresponding gray level data.

Other objects, features, and advantages of the invention will become apparent from the following detailed description of the preferred but non-limiting embodiments. The following description is made with reference to the accompanying drawings.

BRIEF DESCRIPTION OF THE DRAWINGS

FIG. 2 is a 17*17 overdrive look-up table;

FIG. 3 is a 16*16 overdrive look-up table excerpted from the 17*17 overdrive look-up table of the invention;

FIG. 4A and FIG. 4B are overdrive look-up tables according to a first embodiment of the invention; and FIGS. 5A, 5B, 5C and 5D are overdrive look-up tables according to a second embodiment of the invention.

DETAILED DESCRIPTION OF THE INVENTION

Figure 1A:
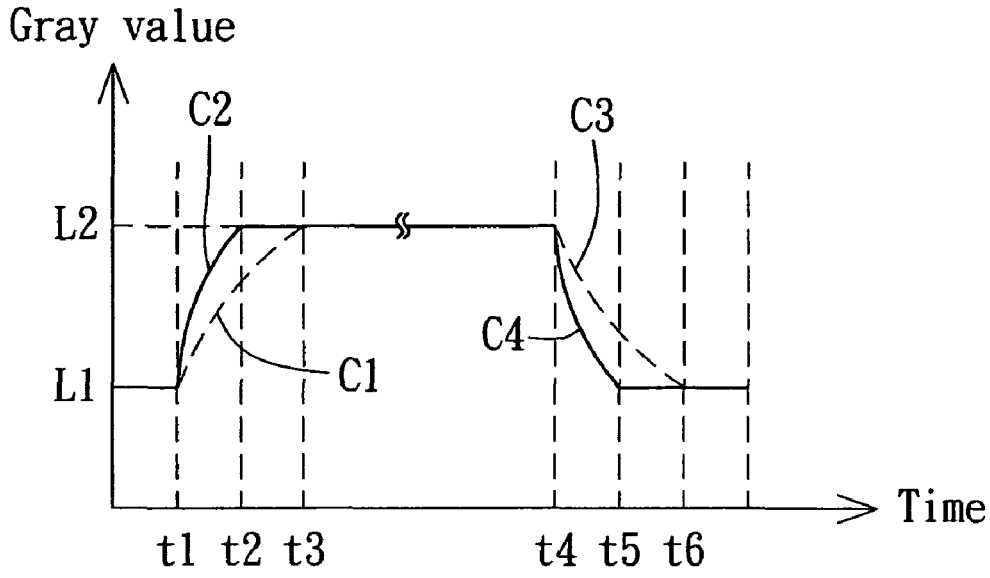
FIG. 1A(PRIOR ART)
FIG. 1A is a timing diagram of gray values of liquid crystal molecules.
Figure 1B:
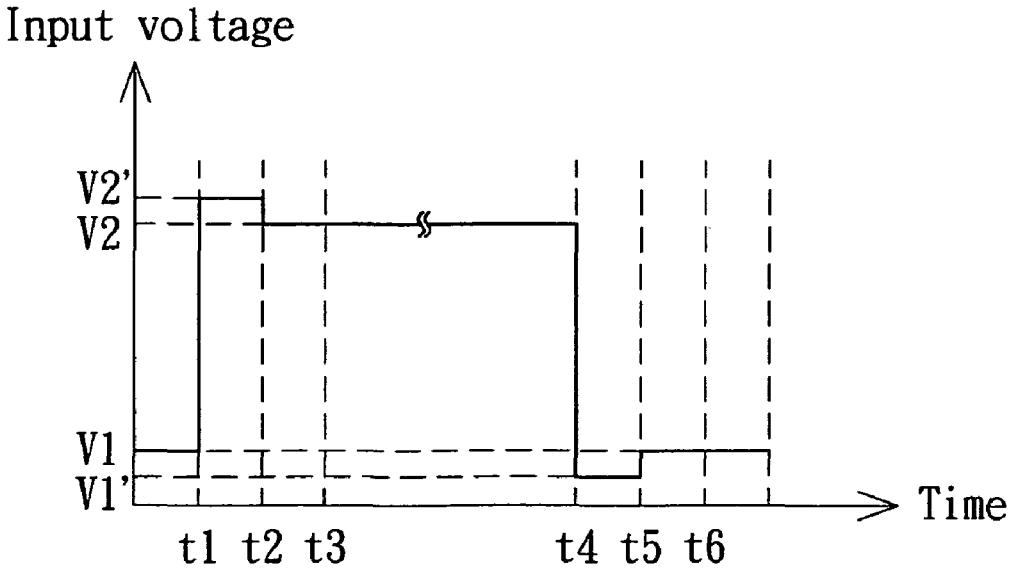
FIG. 1B(PRIOR ART)
FIG. 1B is a timing diagram of input voltages.

The division process of the overdrive look-up table is elaborated below. Referring to FIG. 3, a 16*16 overdrive look-up table excerpted from the 17*17 overdrive look-up table of the invention is shown. If the previous gray level compared value PF is the same with the current gray level compared value CF, the corresponding overdrive gray value OD is omitted. This is because the gray values of the previous frame and the current frame do not change, and it can be known from FIG. 2 that the corresponding overdrive gray value OD is the same with the previous frame gray value and the current frame gray value, and thus can be omitted. If the current gray level compared value CF is the largest gray value, equal to 255 as in FIG. 2, the overdrive gray values OD corresponding to the current gray level compared value CF are all equal to 255 and can be omitted as well. According to the two ways of omission disclosed above, a 16*16 overdrive look-up table of FIG. 3 is obtained. Consequently, the omitted overdrive gray values OD are not stored in the memory unit when storing the overdrive look-up table.

After the above omission steps, the looking-up method of FIG. 3 slightly differs with the looking-up method of FIG. 2. If the current gray level compared value CF is larger than the previous gray level compared value PF, the corresponding overdrive gray value OD is positioned at the bottom left of the sectional line L1, and is looked up based on the bottom list of previous gray level compared values PF. If the current gray level compared value CF is smaller than previous gray level compared value PF, the overdrive gray value OD is positioned at the top right of the sectional line L1, and is looked up based on the top list of previous gray level compared values PF. For example, if the current gray level compared value CF equals to 64, and the previous gray level compared value PF equals to 112, meanwhile, the current gray level compared value CF is smaller than the previous gray level compared value PF, and the corresponding overdrive gray value OD is 40. If the current gray level compared value CF equals to 64, and the previous gray level compared value PF equals to 32, meanwhile, the current gray level compared value CF is larger than the previous gray level compared value PF, the corresponding overdrive gray value OD is 96.

First Embodiment

Referring to both FIG. 4A and FIG. 4B overdrive look-up-tables according to a first embodiment of the invention are shown. FIG. 4A is an overdrive look-up table formed by the overdrive gray values OD of odd-numbered columns of FIG. 3. FIG. 4B is an overdrive look-up table formed by the overdrive gray values OD of even-numbered columns of FIG. 3. According to the present embodiment, the 16*16 overdrive look-up table is divided into two overdrive look-up tables. In terms of application, the overdrive look-up table of FIG. 4A and that of FIG. 4B are respectively stored in two memory units of the overdrive data modifier, so that in terms of a memory unit, it needs to read the overdrive gray value OD only twice within a clock cycle.

When looking up the table in FIG. 4A, if the current gray level compared value CF is larger than the previous gray level compared value PF, the overdrive gray value OD is positioned at the bottom left of the sectional line L21, and is looked up based on the bottom list of previous gray level compared values PF. If the current gray level compared value CF is smaller than the previous gray level compared value PF, the overdrive gray value OD is positioned at the top right of the sectional line L21, and is looked up based on the top list of previous gray level compared values PF. When looking up the table in FIG. 4B, a sectional line L22 is used as a standard of reference, and the looking-up method is the same as that in FIG. 4A. Similarly, individual overdrive look-up table can also be formed by combining the overdrive gray values OD of odd-numbered rows with the overdrive gray values OD of even-numbered rows.

Second Embodiment

Referring to both FIG. 5A, FIG. 5B, FIG. 5C and FIG. 5D, overdrive look-up tables according to a second embodiment of the invention are shown. FIG. 5A is an overdrive look-up table formed by the overdrive gray values OD of odd-numbered rows of FIG. 4A. FIG. 5B is an overdrive look-up table formed by the overdrive gray values OD of even-numbered rows of FIG. 4A. FIG. 5C is an overdrive look-up table formed by the overdrive gray values OD of odd-numbered rows of FIG. 4B. FIG. 5D is an overdrive look-up table formed by the overdrive gray values OD of even-numbered rows of FIG. 4B. According to the second embodiment, the 16*16 overdrive look-up table is divided into four overdrive look-up tables. In terms of application, the overdrive look-up table of FIG. 5A, FIG. 5B, FIG. 5C and FIG. 5D are respectively stored in four memory units of the overdrive data modifier, so that in a memory unit, it needs to read the overdrive gray value OD only once within a clock cycle.

When looking up the table in FIG. 5A, if the current gray level compared value CF is larger than the previous gray level compared value PF, the overdrive gray value OD is positioned at the bottom left of the sectional line L31, and is looked up based on the bottom list of previous gray level compared values PF. If the current gray level compared value CF is smaller than previous gray level compared value PF, the overdrive gray value OD is positioned at the top right of the sectional line L31, and is looked up based on the top list of previous gray level compared values PF. Similarly, when looking up the tables in FIGS. 5B, 5C, and 5D, sectional lines L32, L33 and L34 are used as a standard of reference, and the looking-up method is the same as that in FIG. 5A.

In the above FIGS. 3, 4A, 4B, 5A, 5B, 5C and 5D, the correspondence relationship among the overdrive gray value OD, the current gray level compared value CF, and the overdrive gray value OD is recorded in the memory unit first, and recorded in the memory unit according to the address concept of the memory unit later, and are not repeated here Table format, which is not used in practical application, is used to make the spirit of the embodiment and the invention easier to understand. Despite the number of memory units is increased in the invention, the overall capacity of memory units remains the same. While the manufacturing cost is not increased, the reading rate of the memory unit is not subject to any specific limitation.

An example is disclosed below to exemplify the looking-up process of the overdrive gray values OD of the invention. If the overdrive data modifier receives a current frame gray value equal to 74, and a previous frame gray value equal to 180, it can be looked up according to above embodiments that the overdrive gray values OD equal to 24, 16, 48 and 40. According to the first embodiment, the overdrive gray values OD of 24 and 48 are looked up from FIG. 4A and the overdrive gray values OD of 16 and 40 are looked up from FIG. 4B, and the looked up values are accessed from the two memory units of the overdrive data modifier respectively. According to the second embodiment, the overdrive gray value OD of 24 is looked up from FIG. 5A, the overdrive gray value OD of 48 is looked up from FIG. 5B, the overdrive gray value OD of 16 is looked up from FIG. 5C, the overdrive gray value OD of 40 is looked up from FIG. 5D, and the looked up values are read from the four memory units of the overdrive data modifier respectively.

According to the overdrive data modifier and the overdrive method thereof disclosed in above embodiments of the invention, four overdrive gray values can be read from a memory unit within one clock cycle. The conventional overdrive look-up table is omitted and then is divided into two or four overdrive look-up tables, so that the required overdrive gray values can be read from two or four memory units respectively within one clock cycle without being subject to the reading rate of the memory unit.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An overdrive gray level data modifier, obtaining an overdrive gray level data according to M*N overdrive gray values OD(1,1)-OD(M,N) corresponding to M previous gray level compared values PF(1)-PF(M) and N current gra3; level compared values CF(1)-CF(N), the overdrive gray level data modifier comprising: a first memory unit; and a second memory unit; wherein the M previous gray level compared values PF(1)-PF(M) comprise a previous gray level compared value PF(i) and a previous gray level compared value PF(i+l), and the N current gray level compared values CF(1)-CF(N) comprise a current gray level compared value CF(j) and a current gray level compared value CF(j+l), i is smaller than M, j is smaller than N, i, j, M and N are positive integers;

wherein the overdrive gray values OD(i, 1)-OD(i,N) corresponding to the previous graY level compared value PF(i) are stored in the first memory unit;

wherein the overdrive gray values OD(i+l,1)-OD(i+l,N) corresponding to the previous gray level compared value PF(i+l) are stored in the second memory unit;

wherein the overdrive gray level data modifier receives a current flame gray level data and a previous frame gray level data and looks up the overdrive gray values OD(1, 1)-OD(M,N) stored in the first memory unit and the second memory unit to obtain the overdrive gray level data according to the current frame gray level data and the previous frame gray level data.

2. The modifier according to claim 1, wherein if the value of the previous gray level compared value PF(i) and the value of the first current gray level compared value CFG) are the same, the overdrive gray value OD(i, j) corresponding to the first previous gray level compared value PF(i) and the first current gray level compared value CF(j) is not stored in the first memory unit and the second memory unit.

3. The modifier according to claim 1, wherein N is not equal to the largest gray value of gray level data.

4. An overdrive gray level data looking-up method, applied in the overdrive gray level data modifier according to claim 1, wherein the looking-up method comprises:

referring the M previous gray level compared values PF and the N current gray level compared values CF according to the current frame gray level data and the previous frame gray level data to obtain at least a corresponding overdrive gray level data from the overdrive gray values OD; and obtaining the overdrive gray level data according to the corresponding overdrive gray level data.

5. An overdrive gray level data modifier, obtaining an overdrive gray level data according to M*N overdrive gray values OD(1,1)-OD(M,N) corresponding to M previous gray level compared values PF(1)-PF(M) and N current gray level compared values CF(1)-CF(N), the overdrive gray level data modifier comprises: a first memory unit; and a second memory unit; wherein the M previous gray level compared values PF(1)-PF(M) comprise a previous gray level compared value PF(i) and a second previous gray level compared value PF(i+l), and the N current gray level compared values CF(1)-CF(N) comprise a first current gray level compared value CFG) and a second current gray level compared value CF(j+l), i is smaller than M, j is smaller than N, i, j, M and N are integers; wherein the overdrive gray values OD(1, j)-OD(M, j) corresponding to the first current gray level compared value CF(j) are stored in the first memory unit;

wherein the overdrive gray values OD(1, j +1)~OD(M, j+1) corresponding to the second current gray level compared value CF(j+l) are stored in the second memory unit;

wherein the overdrive gray level data modifier receives a current frame gray level data and a previous frame gray level data and looks up the overdrive gray values OD(1, 1)-OD(M,N) stored in the first memory unit and the second memory unit to obtain the overdrive gray level data according to the current frame gray level data and the previous frame gray level data.

6. The modifier according to claim 5, wherein if the value of the first previous gray level compared value PF(i) and the value of the first current gray level compared value CF(j) are the same, the overdrive gray value OD(i, j) corresponding to the first previous gray level compared value PF(i) and the first current gray level compared value CF(j) is not stored in the first memory unit and the second memory unit.

7. The modifier according to claim 5, wherein N is not equal to the largest gray value of gray level data.

8. An overdrive gray level data looking-up method, applied in the overdrive gray level data modifier according to claim 5, wherein the looking-up method comprises: referring the M previous gray level compared values PF and the N current gray level compared values CF according to the current frame gray level data and the previous frame gray level data to obtain at least a corresponding overdrive gray level data from the overdrive gray values OD; and obtaining the overdrive gray level data according to the corresponding overdrive gray level data.

9. A gray level data device, obtaining a drive gray level data according to M*N gray values OD(1,1)-OD(M,N) corresponding to M first gray level compared values X(1)-X(M) and N second gray level compared values Y(1)-Y(N), the gray level data device comprising: a first memory unit; and a second memory unit;

wherein the M first gray level compared values X(1)-X(M) comprise a first gray level compared value X(i), and the N second gray level compared values Y(1)-Y(N) comprise a second gray level compared value Y(j), i is smaller than or equal to M, j is smaller than or equal to N, i, j, M and N are integers; wherein ifi is an odd number, gray values OD(i, 1)~OD(i, N) corresponding to the first gray level compared value X(i) are stored in the first memory unit; wherein if i is an even number, the gray values OD(i, 1)-OD(i, N) corresponding to the first gray level compared value X(i) are stored in the second memory unit; wherein the gray level data device receives a current frame gray level data and a previous frame gray level data and looks up the gray values OD(1,1)~OD(M, N) stored in the first memory unit and the second memory unit to obtain the drive gray level data according to the current frame gray level data and the previous frame gray level data.

10. The gray level data device according to claim 9, wherein, the first memory unit further comprises: a third memory unit; and a fourth memory unit; wherein if both i and j are odd numbers, a gray value OD(i, j) corresponding to the first gray level compared value X(i) and the second gray level compared value Y(j) is stored in the third memory unit; wherein if i is an odd number, j is an even number, the gray value OD(i, j) corresponding to the first gray level compared value X(i) and the second gray level compared value Y(j) is stored in the fourth memory unit.

11. The gray level data device according to claim 9, wherein if the first gray level compared value X(i) and the second gray level compared value Y(j) are the same, a gray value OD(i, j) corresponding to the first gray level compared value X(i) and the second gray level compared value Y(j) is not stored in the first memory unit and the second memory unit.

12. The gray level data device according to claim 9, wherein N is not equal to the largest gray value of gray level data.

13. A gray level data looking-up method, applied in the gray level data device according to claim 9, the looking-up method comprising:

referring the first gray level compared value X and the second gray level compared value Y according to the previous frame gray level data and the current frame gray level data to obtain at least a corresponding gray level data from the gray values OD; and obtaining the drive gray level data according to the corresponding gray level data.

14. A gray level data looking-up method, applied in the gray level data device according to claim 9, the looking-up method comprising:

referring the first gray level compared value X and the second gray level compared value Y according to the previous frame gray level data and the current frame gray level data to obtain a first corresponding gray level data from the first memory unit and obtain a second corresponding gray level data from the second memory unit; and obtaining the drive gray level data according to the first and the second corresponding gray level data.

15. The gray level data looking-up method according to claim 14, is completed within two clock cycles.

16. A gray level data looking-up method, applied in the gray level data device according to claim 10, the looking-up method comprising:

referring the first gray level compared value X and the second gray level compared value Y according to the previous frame gray level data and the current frame gray level data to obtain at least a corresponding gray level data from the gray values OD; and obtaining the drive gray level data according to the corresponding gray level data;

wherein the gray level data looking-up method is completed within one clock cycle.

* * * * *